US008382098B2

(12) United States Patent
Gao et al.

(10) Patent No.: US 8,382,098 B2
(45) Date of Patent: Feb. 26, 2013

(54) RECORDING MEDIUM OVERTURNING DEVICE AND RECORDING MEDIUM PROCESSING APPARATUS USING THE SAME

(75) Inventors: Ming Gao, Weihai (CN); Zhenxing Zhao, Weihai (CN); Jigang Zhang, Weihai (CN); Kai Liu, Weihai (CN)

(73) Assignee: Shangdong New Beiyang Information Technology Co., Ltd., Weihai (CN)

( * ) Notice: Subject to any disclaimer, the term of this patent is extended or adjusted under 35 U.S.C. 154(b) by 0 days.

(21) Appl. No.: 13/393,439

(22) PCT Filed: Aug. 18, 2010

(86) PCT No.: PCT/CN2010/076118

§ 371 (c)(1),
(2), (4) Date: Feb. 29, 2012

(87) PCT Pub. No.: WO2011/026394

PCT Pub. Date: Mar. 10, 2011

(65) Prior Publication Data

US 2012/0267843 A1 Oct. 25, 2012

(30) Foreign Application Priority Data

Sep. 1, 2009 (CN) ..... 2009 1 0170025

(51) Int. Cl.
*B65H 29/00* (2006.01)

(52) U.S. Cl. ..... 271/186; 271/291; 399/364; 399/401

(58) Field of Classification Search ..... 271/186, 271/291; 399/364, 401
See application file for complete search history.

(56) References Cited

U.S. PATENT DOCUMENTS 5,133,541 A 7/1992 Murasaki et al.

FOREIGN PATENT DOCUMENTS

| | | | |
|---|---|---|---|
| CN | 201485087 | U | 5/2010 |
| CN | 201494941 | U | 6/2010 |
| JP | 5131702 | A | 5/1993 |
| JP | 6271166 | A | 9/1994 |
| JP | 2005324922 | A | 11/2005 |
| JP | 2007223711 | A | 9/2007 |

OTHER PUBLICATIONS

International Search Report for corresponding PCT Application No. PCT/CN2010/076118 (6 pgs.).

*Primary Examiner* — David H Bollinger
(74) *Attorney, Agent, or Firm* — Shumaker & Sieffert, P.A.

(57) ABSTRACT

The present invention provides a recording medium turnover device and a recording medium processing apparatus using the same. The recording medium turnover device comprises: a passage assembly, configured to form a first passage (3), one end of which is connected with a recording medium inlet (1) and the other end of which is connected with a recording medium outlet (2); a turnover mechanism (4), which is located on one side of the passage assembly and comprises a first plate (41) being located below the outlet and extending away from the outlet and a second plate (42) swingably arranged between the outlet and the inlet and forming a recording medium containing space with the first plate; conveying rollers (411, 424), configured to convey the recording medium; and a guide plate (5), which is controlled to guide the recording medium to enter the first passage or the recording medium containing space of the turnover mechanism. According to the present invention, the first passage and the turnover mechanism can share one power device to convey the recording medium, without switching the position state and the rotating direction of a plurality of mechanisms as in the conventional art, so that the structure of the recording medium turnover device and the control method are simplified, thus the number of power devices is decreased and the cost of devices is reduced.

10 Claims, 9 Drawing Sheets

RECORDING MEDIUM OVERTURNING DEVICE AND RECORDING MEDIUM PROCESSING APPARATUS USING THE SAME

The application claims the priority of Chinese patent for invention with application No. 200910170025.5, titled as "RECORDING MEDIUM TURNOVER DEVICE AND RECORDING MEDIUM PROCESSING APPARATUS USING the SAME" and submitted in Sep. 1, 2009, and all disclosed contents thereof should be incorporated herein by reference.

TECHNICAL FIELD OF THE INVENTION

The present invention relates to a recording medium turnover device and a recording medium processing apparatus using the same.

BACKGROUND OF THE INVENTION

As well known, the recording medium comprises two sides. In one case, the two sides are completely identical without any difference; in the other case, the two sides are not completely identical. With a thermal paper as the example, one side of the thermal paper has a thermal coating while the other side does not have thermal coating. Again with a magnetic ticket as the example, one side of the magnetic ticket has a magnetic stripe while the other side does not have a magnetic stripe. For the convenience of description, a recording medium with two sides which are not completely identical is called a recording medium with a front side and a back side, wherein the front side is called as the side to be processed, and the back side is called as the side not to be processed.

In traditional recording medium processing apparatuses, for example, with print devices and magnetic head devices, as the print heads or magnetic heads are located on one side of the passage, the front side (that is, the print side or the magnetic side) of the recording medium is required to be opposite to the print heads or magnetic heads. However, due to mistaken operation of an operator, the front side of the recording medium is often not opposite to the print heads or magnetic heads, so it is unable to smoothly realize the printing or reading/writing magnetic of the recording medium.

To solve the problem, Japanese invention JP06-271166A proposes a recording medium processing device, as shown in FIG. 1*a*, FIG. 1*b* and FIG. 1*c*, wherein FIG. 1*a* shows a conveying path of the recording medium when the recording medium is a non-turned-over recording medium. A switching element 81 rotates along the direction D, so that the recording medium 2 enters the first passage 10 via the inlet A and then outputs from the outlet. FIG. 1*b* and FIG. 1*c* show the conveying path of the recording medium when the recording medium is a turned-over recording medium. The specific method is as follows: step (a): the switching element 81 rotates along the direction F, so that the recording medium 2 enters the second passage 20 from the inlet A; and an electromagnet 82 drives the driving roller 77 and the driven roller 75 of the second passage 20 to cooperate with each other, so as to drive the medium to enter the second passage 20; step (b): the electromagnet 82 drives the driving roller 77 and the driven roller 75 of the second passage 20 to separate from each other, and simultaneously drives the a floating wheel 74 and a rotating roller 80 to cooperate with each other, so as to convey the medium into the second passage 20 along a direction opposite to that in step (a) and then output the medium from the outlet.

However, the turnover devices in the conventional art at least have the following problems: an existing recording medium turnover device comprises a first passage, a second passage, a switching element, an electromagnet and a rotating roller and so on, and the first passage and the second passage in turn comprise a plurality of belts and plural rotating rollers, therefore the structure of the device is complicated; simultaneously, when the recording medium is overturned, the switching element and the driving roller and the floating wheel of the second passage need to be switched, therefore the control is complicated.

SUMMARY OF THE INVENTION

The purpose of the present invention is to provide a recording medium turnover device and a recording medium processing apparatus using the same, which are simple in both structure and control.

To realize the purpose, according to one aspect of the present invention, a recording medium turnover device is provided, comprising: a passage assembly, configured to form a first passage, one end of which is connected with a recording medium inlet and the other end of which is connected with a recording medium outlet; a turnover mechanism, which is located on one side of the passage assembly, wherein the turnover mechanism comprises: a first plate located below the outlet and extending away from the outlet, a second plate swingably arranged between the outlet and the inlet and forming a recording medium containing space between the second plate and the first plate, and conveying rollers configured to convey the recording medium; and a guide plate, located at the intersection of the inlet, the first passage and the turnover mechanism, to controllably guide the recording medium to enter the first passage or the recording medium containing space of the turnover mechanism.

Further, the second plate comprises: a movable plate body articulated to a frame through a rotating shaft; and a driving mechanism, configured to drive the movable plate body to rotate with respect to a fixed plate.

Further, the driving mechanism is a cam mechanism or an electromagnet mechanism.

Further, the first plate is a fixed plate, a driving roller of the conveying rollers is arranged on the first plate, and a driven roller of the conveying rollers is arranged on the second plate.

Further, the recording medium turnover device further comprises: a floating plate articulated to the frame and suitable for opening/closing an output end of the turnover mechanism, the output end located between the first passage and the outlet.

Further, the conveying direction of the recording medium in the first passage is inclined upwards.

According to another aspect of the present invention, a recording medium processing apparatus is also provided, comprising: a recording medium turnover device described above; a ticket surface identification device, provided at the inlet of the first passage of the recording medium turnover device, and configured to identify the front-side feature of the recording medium, to determine whether to turn the recording medium over; a processing device arranged at the outlet of the first passage of the recording medium turnover device, and configured to process the recording medium.

Preferably, the ticket surface identification device is magnetic head identification devices provided on two sides of the first passage.

Preferably, the processing device is a print device or magnetic head identification device.

The present invention has the features as follows: when it is needed to turn the recording medium over, the guide plate is controlled to guide the recording medium to the turnover mechanism; then the movable plate of the turnover mechanism is controlled to switch from the initial position to the conveying position, to realize the turnover of the recording medium, without switching the position state and the rotating direction of a plurality of mechanisms as in the conventional art. Simultaneously, the first passage and the turnover mechanism can share one power device to convey the recording medium. In this way, not only the structure and the control method of the recording medium turnover device are simplified, but also, the number of power devices is decreased and the cost of devices is reduced.

Besides purposes, features and advantages described above, the present invention also has other purposes, features and advantages. Other purposes, features and advantages of the present invention will be further described in details below with reference to drawings.

BRIEF DESCRIPTION OF THE DRAWINGS

Drawings, which form a part of the description and are provided for further understanding of the present invention, show the preferred embodiments of the present invention, and explain the principle of the present invention together with the description. In the drawings.

DETAILED DESCRIPTION OF THE INVENTION

Figure 1A:
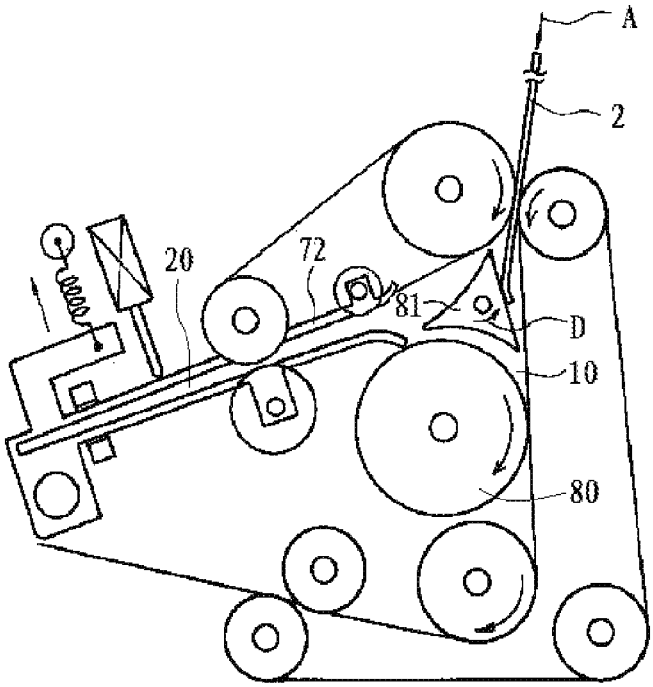
FIG. 1*a* shows a diagram of a recording medium turnover device in the conventional art, wherein the shown state is of the conveying path of the recording medium when it is not overturned.
Figure 1B:
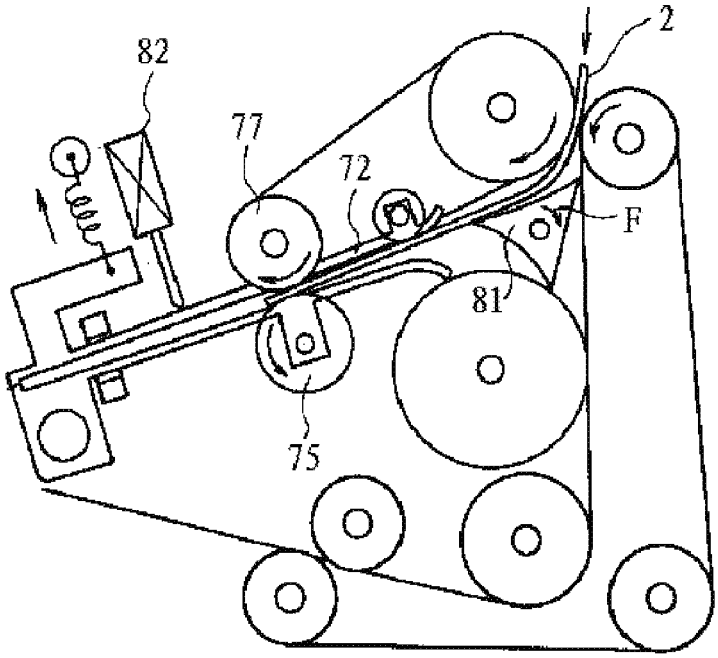
FIG. 1*b* shows the diagram of a recording medium turnover device in the conventional art, wherein the shown state is of the first conveying path of the recording medium when it is overturned.
Figure 1C:
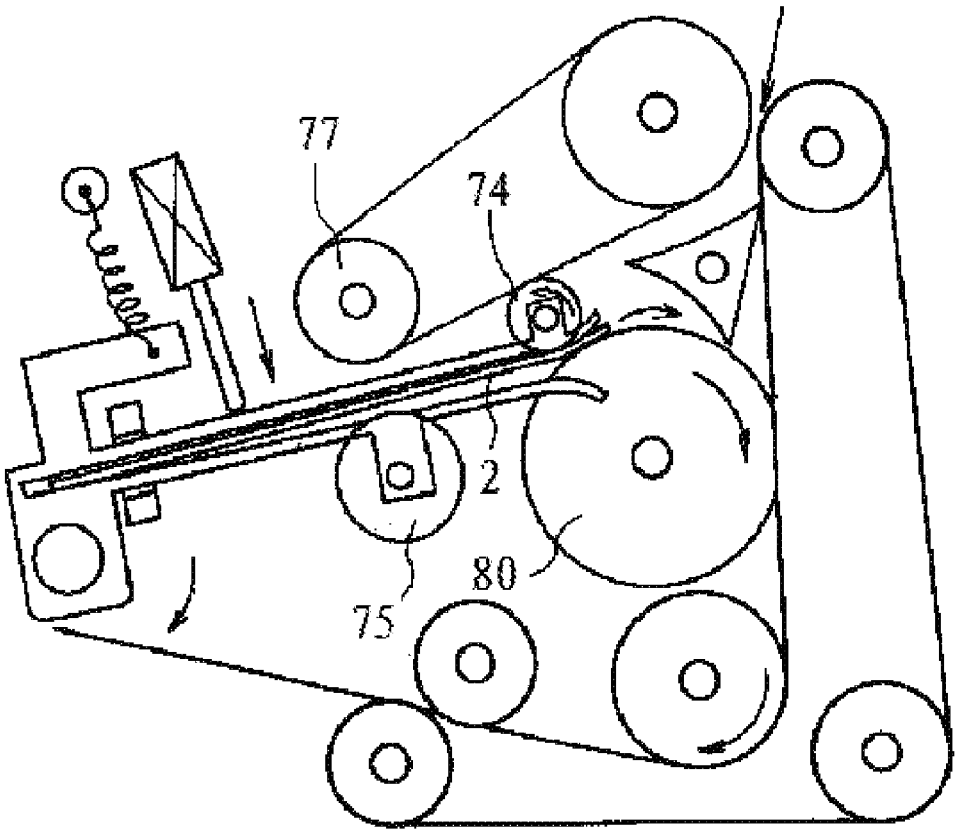
FIG. 1*c* shows the diagram of a recording medium turnover device in the conventional art, wherein the shown state is of the second conveying path of the recording medium when it is overturned.

The embodiments of the present invention will be described in detail below with reference to drawings, however the present invention may be implemented by various different ways defined and covered by the claims. In the drawings, identical components are indicated by identical reference number.

FIG. 2 to FIG. 5 show the structure diagram of a recording medium turnover device according to the first embodiment of the present invention. With reference to FIG. 2 to FIG. 5, the recording medium turnover device comprises a passage assembly configured to form a first passage 3, a turnover mechanism 4 and a guide plate 5.

The two ends of the first passage 3 are connected with an inlet 1 and an outlet 2, respectively, and the recording medium not to be turned-over enters the first passage 3 via the inlet 1 and then outputs from the outlet 2.

The turnover mechanism 4 is located on one side of the first passage and provided with an input end 31 and an output end 32. The input end 31 is connected with the inlet 1, the output end 32 is connected with the outlet 2, the input end 31 is configured to receive the recording medium to be turned-over input from the inlet 1 and output the turned-over recording medium from the output end 32.

Figure 8:
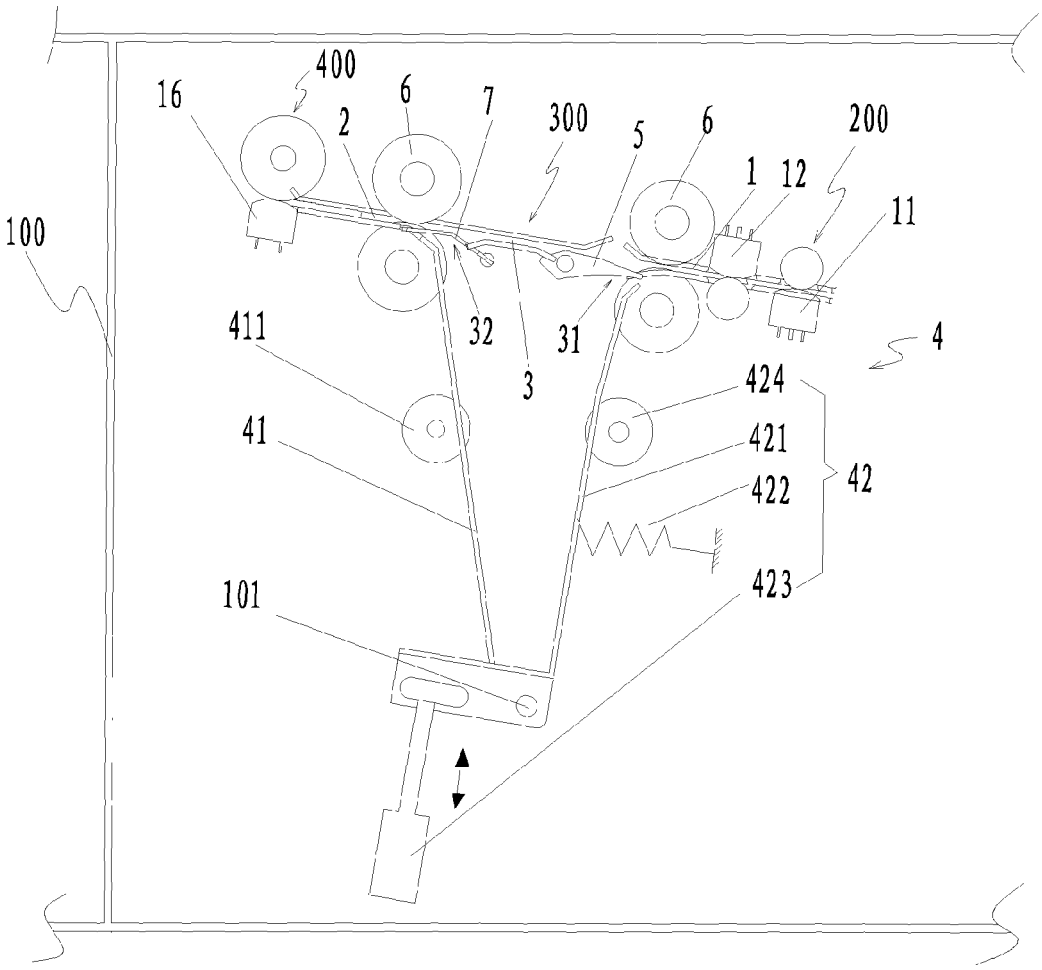
FIG. 8 shows the diagram of a recording medium processing apparatus according to one embodiment of the present invention.

The guide plate 5 is located at the intersection of the inlet 1, the first passage 3 and the turnover mechanism 4, is articulated with a frame 100 (as shown in FIG. 8), and is capable of rotating with respect to the frame 100. The guide plate 5 is provided with a first position and a second position, which are configured to guide the recording medium to enter the first passage 3 or the turnover mechanism 4.

Figure 2:
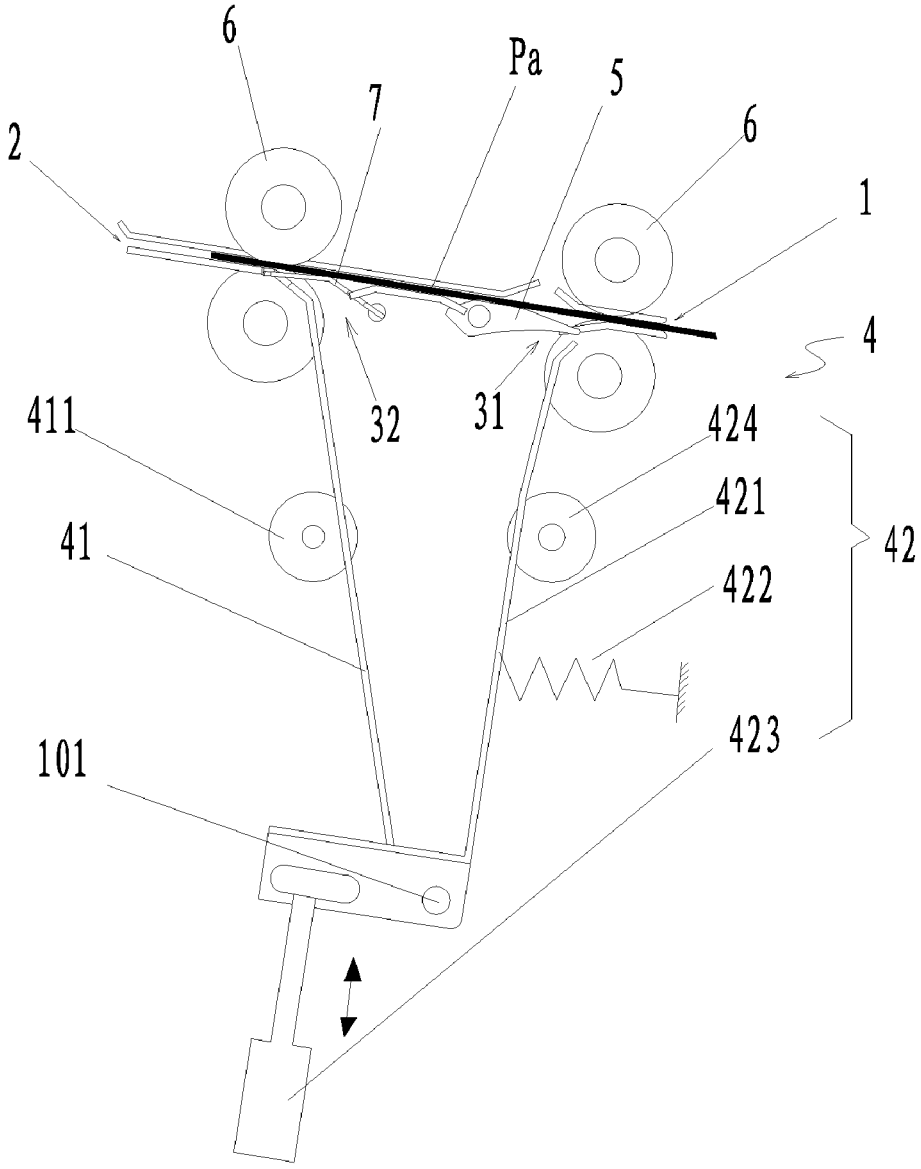
FIG. 2 shows the diagram of a recording medium turnover device according to the first embodiment of the present invention, wherein the recording medium is located in the first passage.

As shown in FIG. 2, when it is not needed to turn the recording medium over, the guide plate 5 is located in the first position to communicate the first passage 3 with the inlet 1 and close the input end 31 of the turnover mechanism simultaneously. In this way, it is only possible for the recording medium not to be turned-over to be discharged from the first passage 3 through the outlet 2.

Figure 3:
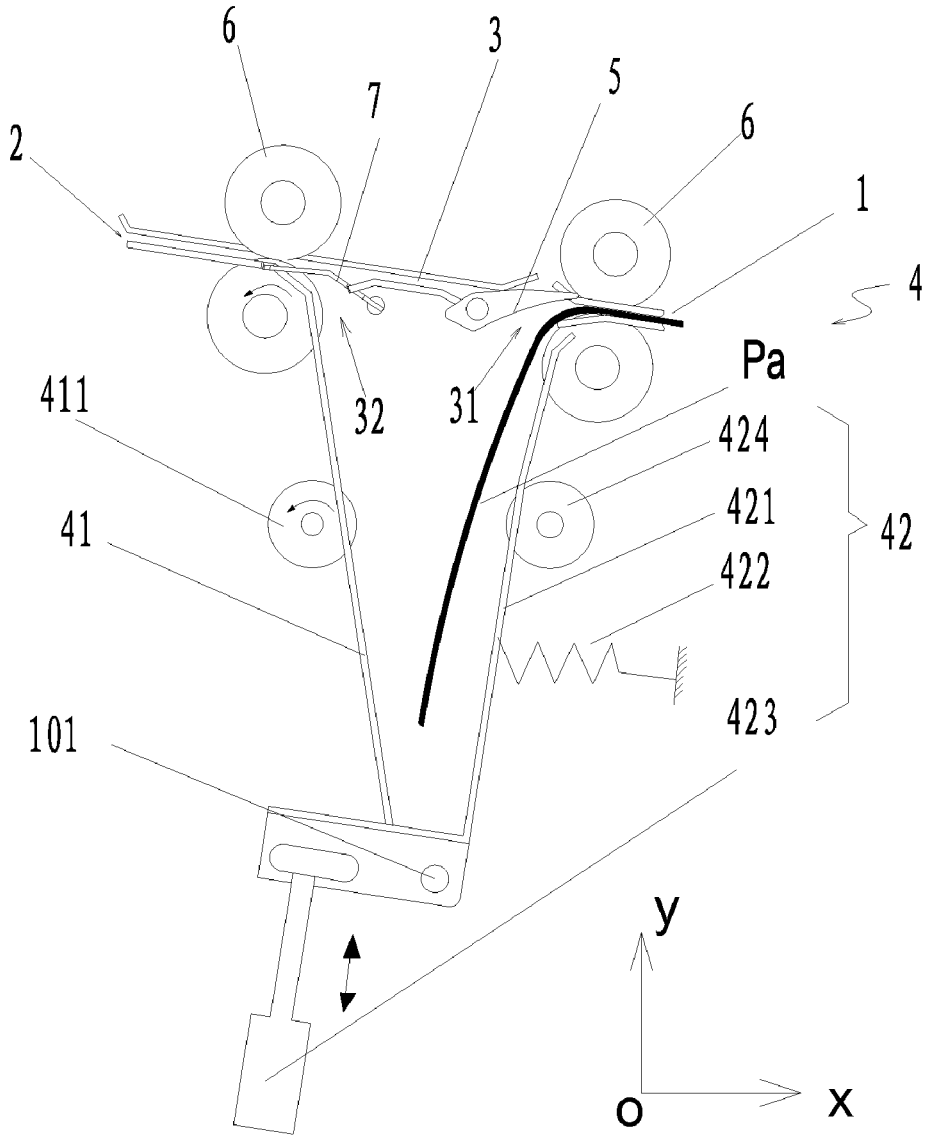
FIG. 3 shows the diagram of the recording medium turnover device according to the first embodiment of the present invention, wherein the recording medium is located in the switchover passage, the movable plate is located in the initial position, and the recording medium is input from the inlet of the turnover mechanism.

As shown in FIG. 3, when it is needed to turn the recording medium over, the guide plate 5 is located in the second position to communicate the inlet 1 with the input end 31 of the turnover mechanism 4 and close the first passage 3 simultaneously. In this way, it is only possible for the recording medium to be turned-over to be discharged by the turnover mechanism 4 through the output end 32 thereof. The first position or the second position of the guide plate 5 is controlled by a first driving mechanism (not shown in the figures), and the first driving mechanism may be an electromagnet or cam.

Figure 4:
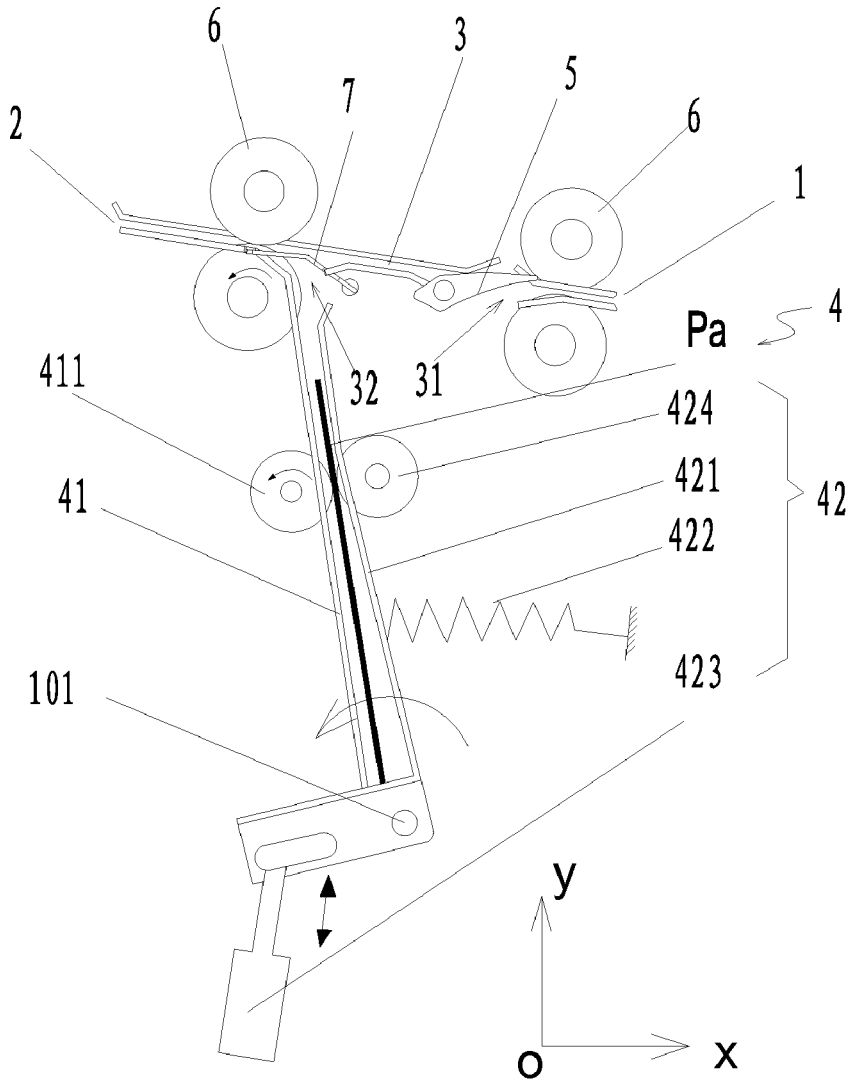
FIG. 4 shows the diagram of the recording medium turnover device according to the first embodiment of the present invention, wherein the recording medium is located in the switchover passage, the movable plate is located in the conveying position, and the recording medium is located between the conveying rollers of the turnover mechanism.

The working implementation of the turnover mechanism will be specifically described below with reference to FIG. 2, FIG. 3 and FIG. 4.

The turnover mechanism 4 comprises a fixed plate 41 and a movable plate 42. The fixed plate 41 is located below the outlet 2 and extends away from the outlet 2. The end of the fixed plate close to the outlet 2 is the output end 32 of the turnover mechanism, and the output end 32 is connected with the outlet 2. The movable plate 42 is articulated with the frame 100 (as shown in FIG. 8) for mounting the recording medium turnover device, and provided with an initial position for receiving the recording medium and a conveying position for conveying the turned-over recording medium. The movable plate can be controllably swingably switched between the initial position and the conveying position. A space which can contain the recording medium is formed between the fixed plate 41 and the movable plate 42. When the movable plate 42 is in the initial position, the end of the movable plate 42 close to the inlet 1 is the input end 31 of the turnover mechanism. When the guide plate is in the second position, the input end 31 of the turnover mechanism is communicated with the inlet 1 to receive the recording medium to be turned-over input from the inlet 1. When the movable plate 42 is in the conveying position, the movable plate 42 is in cooperation with the fixed plate 41 to output the turned-over recording medium to the outlet 2 from the output end 32 of the turnover mechanism.

The movable plate 42 comprises a movable plate body 421, an elastic element 422, a second driving mechanism 423 and a driven roller 424. The movable plate body 421 is articulated with the frame 100 through a rotating shaft 101 and capable of rotating about the rotating shaft 101. One end of the elastic element 422 is connected with the movable plate body 421 and the other end thereof is connected with the frame 100. Under the elasticity effect of the elastic element 422, the movable plate body 421 is kept in the initiation position. The second driving mechanism 423 is connected with one end of the movable plate body 421 to drive the movable plate body 421 to switch to the conveying position from the initial position.

Figure 5:
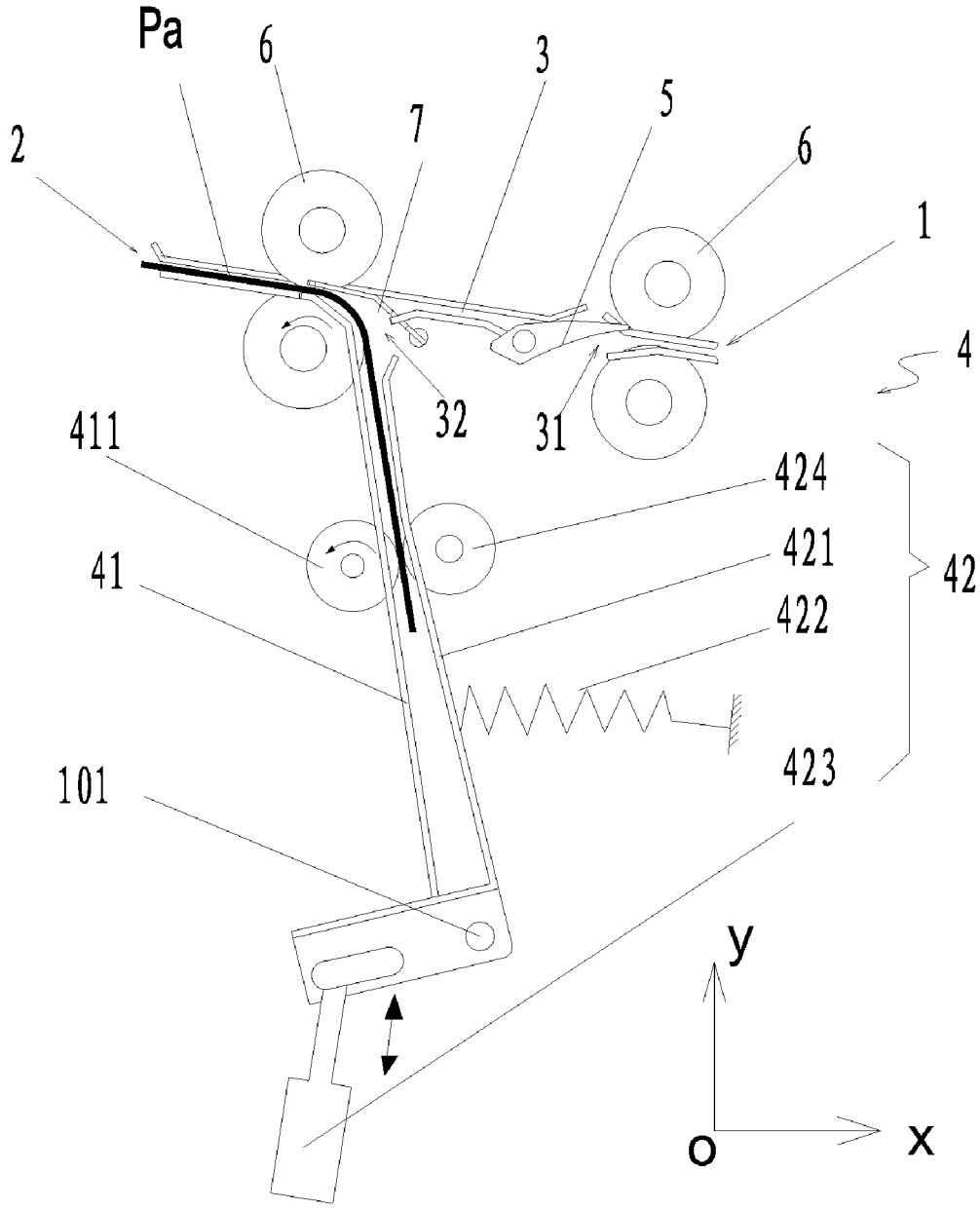
FIG. 5 shows the diagram of the recording medium turnover device according to the first embodiment of the present invention, wherein the recording medium is located in the switchover passage, and the recording medium is output from the outlet of the turnover mechanism.

Specifically, the second driving mechanism 423 may be an electromagnet mechanism. The second driving mechanism 423 shown in FIG. 2 to FIG. 5 is an electromagnet mechanism. In FIG. 2 and FIG. 3, the electromagnet mechanism is in the first position where the movable plate body 421 is in the initial position under the elasticity effect of the elastic element 422. In FIG. 4 and FIG. 5, the electromagnet mechanism is in the second position where the electromagnet mechanism pulls the movable plate body 421 to rotate anticlockwise about the rotating shaft 101, so that the movable plate body 421 can be cooperated with the fixed plate 41. The driven roller 424 is arranged on the movable plate body 421. The driving roller 411 is arranged on the fixed plate 41. When the movable plate body 421 is in the conveying position, the driven roller 424 and the driving roller 411 are in cooperation tangentially to convey the recording medium.

Figure 6:
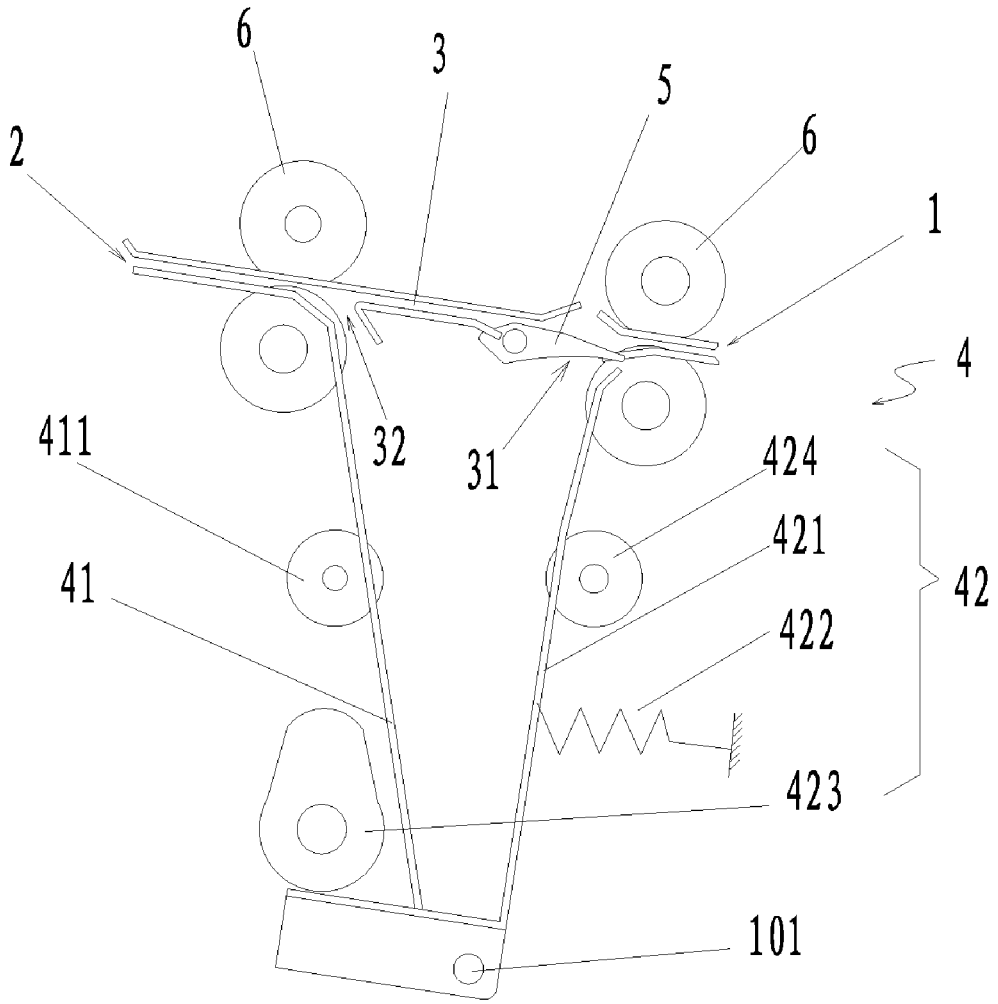
FIG. 6 shows the diagram of a recording medium turnover device according to the second embodiment of the present invention, wherein the recording medium is located in the switchover passage, and the movable plate is located in the initial position.
Figure 7:
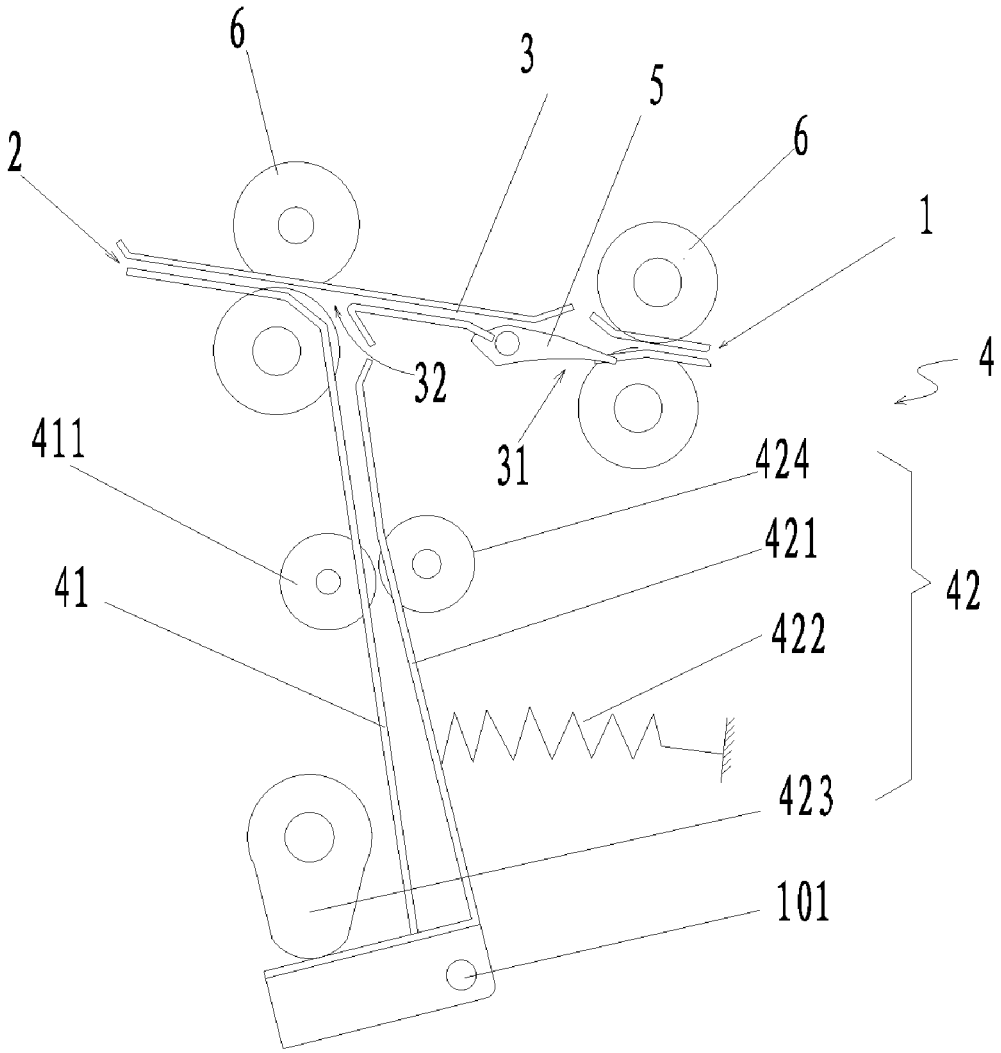
FIG. 7 shows the diagram of the recording medium turnover device according to the second embodiment of the present invention, wherein the recording medium is located in the switchover passage, and the movable plate is located in the conveying position.

It should be noted that the second driving mechanism also may be a cam mechanism, as shown in FIG. 6 and FIG. 7. In FIG. 6, the cam mechanism is in the first position where the movable plate body 421 is in the initial position under the elasticity effect of the elastic element 422. In FIG. 7, the cam mechanism is in the second position where the cam mechanism pushes the movable plate body 421 to rotate anticlockwise about the rotating shaft 101, so that the movable plate body 421 can be in cooperation with the fixed plate 41.

Preferably, a conveying roller 6 for conveying the recording medium is arranged at the inlet 1 and the outlet 2.

Preferably, a floating plate 7 is arranged on the lateral side of the output end 32 of the turnover mechanism, and the floating plate 7 is articulated with the frame 100 to be capable of rotating about the articulated point. The floating plate 7 closes the output end 32 of the turnover mechanism under the gravity effect. When the recording medium is output from the output end 32 of the turnover mechanism 4 under the drive of the driving roller 411 and the driven roller 424, the recording medium can push the floating plate 7 to rotate to communicate the outlet end of the turnover mechanism 4 with the outlet 2.

For one skilled in the art, it is easy to come into mind that the fixed plate 41 may also be a movable plate. When the recording medium is guided into the turnover mechanism from the input end 31 of the turnover mechanism, the turnover mechanism is open in a V-shape to receive the recording medium. When the recording medium is completely guided into the turnover mechanism, the two movable plates of the turnover mechanism clamp the recording medium under an external force, and convey the recording medium towards the outlet 2 when rotating to a position aligned to the output end 32 of the turnover mechanism.

The working principle of the turnover mechanism will be specifically described below with reference to FIG. 2 to FIG. 5. Assuming that the recording medium P with a front side and a back side is input from the inlet 1, when front side is directed upwards, it is unnecessary to be turned-over, and when the back side is directed upwards, it needs to be turned-over.

As shown in FIG. 2, when the front side Pa of the recording medium is directed upwards, the guide plate 5 communicates the inlet 1 with the first passage 3, and the recording medium P enters the first passage 3 via the inlet 1 and then is discharged from the outlet 2.

As shown in FIG. 3, when the front side Pa of the recording medium is directed downwards, the guide plate 5 communicates the inlet 1 with the input end 31 of the turnover mechanism, and the recording medium enters the turnover mechanism 4 via the input end 31 of the turnover mechanism. The following steps are included:

Step 1: The recording medium enters the turnover mechanism 4 under the drive of the conveying roller 6 located at the inlet 1. As the movable plate body 421 is in the initial position, the recording medium substantially vertically falls into the paper containing space formed between the movable plate body 421 and the fixed plate 41, with the support of the movable plate body 421. At this moment, the angle between the front side Pa of the recording medium and X-axis is an acute angle, and the side is directed downwards.

Step 2: As shown in FIG. 4, when the recording medium completely falls into the turnover mechanism 4, the second driving mechanism 423 drives the movable plate body 421 to move to the conveying position from the initial position, the movable plate body 421 simultaneously pushes the recording medium to turn over and clamps the recording medium between the driving roller 411 of the fixed plate 41 and the driven roller 424 of the movable plate body 421. At this moment, the angle between the front side Pa of the recording medium and X-axis is an obtuse angle, and the side is directed upwards.

Step 3: As shown in FIG. 5, the driving roller 411 and the driven roller 424 drive the recording medium P to discharge from the outlet 2. In this way, as the movable plate body 421 is switched to the conveying position from the initial position, the front side Pa of the recording medium is turned-over from being directed downwards to being directed upwards and then the recording medium is discharged from the output end 32 of the turnover mechanism, so that the front side and the back side of the recording medium is turned over.

In addition, it can be seen from the drawing that, the rotation direction of the conveying roller 6 is identical to that of the driving roller 411, therefore the first passage 3 and the turnover mechanism can share one power device (for example, motor) to convey the recording medium, thus the cost of devices is reduced.

The specific embodiment of the present invention further provides a recording medium processing apparatus having the turnover mechanism, as shown in FIG. 8. The recording medium processing apparatus comprises a ticket surface identification device 200, a recording medium turnover device 300 as described in any technical solution aforementioned, and a processing device 400. The ticket surface identification device 200 is located at the inlet 1 of the recording medium turnover device 300, and the processing device 400 is located at the outlet 2 of the recording medium turnover device 300.

The ticket surface identification device 200 is configured to judge whether it is needed to turn the recording medium over; the recording medium turnover device 300 carries out corresponding turnover operations for the recording medium according to the result of judgment of the ticket surface identification device 200. The processing device 400 is configured to process the recording medium. The processing device may be a print device and also may be a magnetic head device, configured to read magnetic data from or write magnetic data onto the magnetic stripe of the recording medium. In the embodiment, the processing device 400 is a magnetic head device 16. For the ticket paper passing through the recording medium turnover device 300, the front side thereof (that is, the side to be processed) is opposite to the processing device (for example, the print head of the print device or the magnetic head of the reading or writing magnetic device).

The working process of the recording medium processing apparatus will be described in details below.

The ticket surface identification device 200 judges whether the position of the front side of the recording medium is opposite to the processing device by identifying the features of the front side of the recording medium, to determine whether to turn the recording medium over. When the front side of the recording medium is opposite to the processing device, it is not needed to turn the recording medium over; and when the front side of the recording medium is not opposite to the processing device, it is needed to turn the recording medium over.

As different recording mediums have different features in their front sides, the ticket surface identification devices are different. When one side of a recording medium has a magnetic stripe, the ticket surface identification device 200 may be a magnetic head identification device, for example, the opposite magnetic heads 11 and 12 are arranged on two sides of the recording medium conveying passage, respectively, and information on the recording medium is read by the two magnetic heads simultaneously, to determine the position of the magnetic stripe. When one side of a recording medium has a mark, the ticket surface identification device 200 may be an optical module identification device (not shown), for example, a CCD or CIS or photoelectric sensor and the like, two opposite optical modules are arranged on two sides of the recording medium passage, respectively, and mark information on the recording medium is read by the two optical modules simultaneously, to determine the position of the mark.

In this way, when it is not needed to turn the recording medium over, the recording medium is driven to enter the first passage 3 via the inlet 1 of the recording medium turnover device 300 and then be discharged to the processing device 400 from the outlet 2 of the recording medium turnover device 300. When it is needed to turn the recording medium over, the recording medium is driven to enter the turnover mechanism 4 via the inlet 1 to be turned-over by the turnover mechanism 4 and then to enter the processing device 400 at the outlet 2 from the output end 32 of the turnover mechanism 400. The above description is referred to, for the movement process of the recording medium in the turnover mechanism 4, which will not be described again herein.

For the recording medium output from the recording medium turnover device 300, the front side thereof (the side to be processed) is opposite to the processing device 400, so that the processing device 400 can carry out corresponding processing for it, for example, printing or reading/writing magnetic and the like.

Above contents only describe the preferred embodiments of the present invention and are not intended to limit the present invention; for one skilled in the art, the present invention may have various modifications and changes. Any modifications, equivalent replacements and improvements made within the spirit and principle of the present invention should be included within the protection scope of the present invention.

The invention claimed is:

1. A recording medium turnover device comprising:

a passage assembly, configured to form a first passage, one end of which is connected with a recording medium inlet and the other end of which is connected with a recording medium outlet, a turnover mechanism, which is located on one side of the passage assembly, wherein the turnover mechanism comprises:

a first plate, located below the outlet and extending away from the outlet; a second plate, swingably arranged between the outlet and the inlet and forming a recording medium containing space between the second plate and the first plate; and conveying rollers, configured to convey the recording medium, and a guide plate, located at the intersection of the inlet, the first passage and the turnover mechanism, to controllably guide the recording medium to enter the first passage or the recording medium containing space of the turnover mechanism.

2. The recording medium turnover device according to claim 1, wherein the second plate comprises:

a plate body, articulated to a frame through a rotating shaft; and a driving mechanism, configured to drive the plate body to rotate with respect to the first plate.

3. The recording medium turnover device according to claim 2, wherein the driving mechanism is an electromagnet mechanism.

4. The recording medium turnover device according to claim 2, wherein the driving mechanism is a cam mechanism.

5. The recording medium turnover device according to claim 1, wherein the first plate is a fixed plate, a driving roller of the conveying rollers is arranged on the first plate, and a driven roller of the conveying rollers is arranged on the second plate.

6. The recording medium turnover device according to claim 2, further comprising:

a floating plate, articulated to the frame and suitable for opening/closing an output end of the turnover mechanism, the output end located between the first passage and the outlet.

7. The recording medium turnover device according to claim 1, wherein the inlet and the outlet are respectively provided with a conveying roller for conveying the recording medium.

8. A recording medium processing apparatus comprising:

a recording medium turnover device according to claim 1;

a ticket surface identification device, provided at the inlet of the first passage of the recording medium turnover device, and configured to identify the front-side feature of the recording medium, to determine whether to turn the recording medium over;

a processing device, arranged at the outlet of the first passage of the recording medium turnover device (300), and configured to process the recording medium.

9. The recording medium processing apparatus according to claim 8, wherein the ticket surface identification device is a plurality of magnetic head identification devices provided on two sides of the first passage.

10. The recording medium processing apparatus according to claim 9, wherein the processing device is a print device or magnetic head identification device.

* * * * *